US009850057B2

(12) United States Patent
Navarrette

(10) Patent No.: US 9,850,057 B2
(45) Date of Patent: Dec. 26, 2017

(54) UNIVERSAL INSULATING BINDER

(71) Applicant: Tom A. Navarrette, Albuquerque, NM (US)

(72) Inventor: Tom A. Navarrette, Albuquerque, NM (US)

( * ) Notice: Subject to any disclaimer, the term of this patent is extended or adjusted under 35 U.S.C. 154(b) by 0 days.

(21) Appl. No.: 15/222,518

(22) Filed: Jul. 28, 2016

(65) Prior Publication Data

US 2017/0240339 A1 Aug. 24, 2017

Related U.S. Application Data

(60) Provisional application No. 62/297,797, filed on Feb. 19, 2016.

(51) Int. Cl.
*B65D 25/00* (2006.01)
*B65D 81/38* (2006.01)
*A47G 23/02* (2006.01)

(52) U.S. Cl.
CPC ..... *B65D 81/3886* (2013.01); *A47G 23/0216* (2013.01); *A47G 2023/0291* (2013.01)

(58) Field of Classification Search
CPC ..... B65D 81/3886; B65D 81/3879; A47G 23/0216; A47G 2023/0283; A47G 2023/0291; A47G 23/0266
USPC ..... 220/739
See application file for complete search history.

(56) References Cited

U.S. PATENT DOCUMENTS 4,282,279 A * 8/1981 Strickland ..... B65D 25/34 150/901
5,425,497 A * 6/1995 Sorensen ..... A47G 23/0216 220/738
5,845,804 A * 12/1998 Prescott ..... B65D 81/3879 215/12.1
6,286,798 B1 * 9/2001 Chun ..... A47G 23/0216 206/218
6,425,494 B1 * 7/2002 Woods, II ..... B65D 81/3879 215/12.1

* cited by examiner

*Primary Examiner* — Andrew T Kirsch

(57) ABSTRACT

The universal insulating binder limits the heat transfer process of a variety of beverage containers. The universal insulating binder includes a coiled cuff body and an insulating layer. The coiled cuff body defines the configuration of the insulating layer and secures the insulating layer against the exterior of a variety of beverage containers. The insulating layer presses against an engaged beverage container and limits the heat transfer between the engaged beverage container and the surrounding environment. The coiled cuff body may include a bendable cuff-shaped shell and a torsion spring or the coiled cuff body may be the torsion spring. The bendable cuff-shaped shell houses the torsion spring. The torsion spring defines the configuration of the universal insulating binder. The universal insulating binder may further include a plurality of non-slip members. The plurality of non-slip members directly increases the friction between the engaged beverage container and the coiled cuff body.

6 Claims, 7 Drawing Sheets

UNIVERSAL INSULATING BINDER

The current application claims a priority to the U.S. Provisional Patent application Ser. No. 62/297,797 filed on Feb. 19, 2016.

FIELD OF THE INVENTION

The present invention relates generally to insulating binders. More specifically, the present invention is universal insulating binder that can fit variety of beverage containers.

BACKGROUND OF THE INVENTION

There are numerous devices that insulate beverage containers and fit beverage cups of varying sizes. The common feature among these types of devices being rigid coils that surround the beverage container while having insulation properties. Some of these devices are flexible, have different shapes, and are multi-layered. However, these features exist separately in different devices. There is no individual device that incorporates all of these aforementioned features in a single device.

The present invention offers a universal fit for securely holding and insulating a variety of beverage containers. The beverage containers may comprise varying contours and sizes. The non-slip insulating interior along with the rigid coiled exterior of the present invention are the keys to securely holding containers of different shapes and materials. The pliable interior of the present invention allows for more surface area of a contoured container to contact the non-slip insulation. The rigid coiled exterior defines the configuration of the non-slip insulating interior. Together, the rigid coiled exterior and the non-slip insulating interior work together to securely hold containers ranging from soft drink bottles, large convenience store cups, kitchen glasses (trapezoid), and most aluminum beverage containers (rectangle). The present invention is reusable multiple times, reducing waste. The present invention is also washable and configured with no moving parts that may break or accidentally separate. The present invention can be coiled inside one another for ease of storage and shipping.

DETAILED DESCRIPTION OF THE INVENTION

All illustrations of the drawings are for the purpose of describing selected versions of the present invention and are not intended to limit the scope of the present invention.

Figure 1:
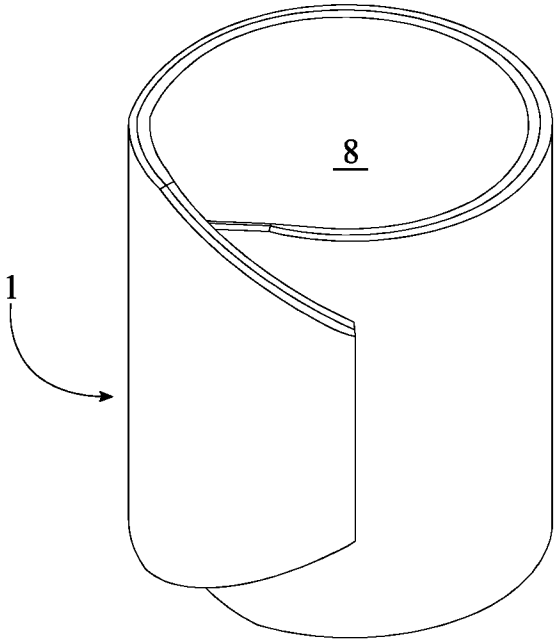
FIG. 1 is a front perspective view of the present invention in a rolled configuration.
Figure 2:
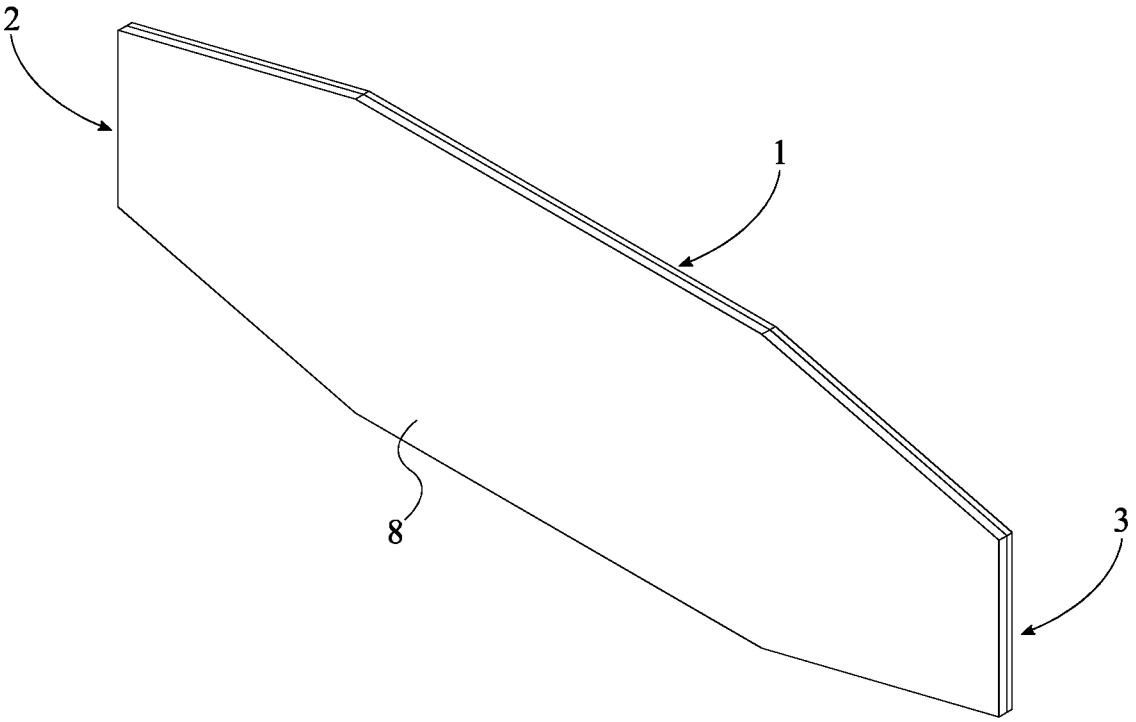
FIG. 2 is a front perspective view of the present invention in a flat configuration.

The present invention is a universal insulating binder that securely holds and insulates a variety of beverage containers. The beverage containers may comprise varying contours and sizes. The beverage containers are not limited to any size. The present invention is designed to wrap around a variety of beverage containers while simultaneously insulating the engaged beverage container. The present invention wraps around a variety of beverage containers in a rolled configuration as illustrated in FIG. 1. As a result, the present invention applies pressure to the engaged beverage container and limits the heat transfer process. The present invention comprises a coiled cuff body 1 and an insulating layer 8. The coiled cuff body 1 fastens the present invention around the beverage container. Furthermore, the coiled cuff body 1 applies pressure to the insulating layer 8 and consequently the exterior surface of the engaged beverage container. The coiled cuff body 1 preferably comprises elastic materials that provide rigidity to the present invention. These elastic materials include but are not limited to plastic and metal. The insulating layer 8 mirrors the same configuration as that of the coiled cuff body 1, as shown in the front perspective view of FIG. 7. The insulating layer 8 directly presses against the engaged beverage container. The insulating layer 8 limits the heat transfer process from the engaged beverage container to the surrounding environment. The insulating layer 8 may comprise but is not limited to neoprene, foam, and a variety of comparable insulating materials.

Figure 3:
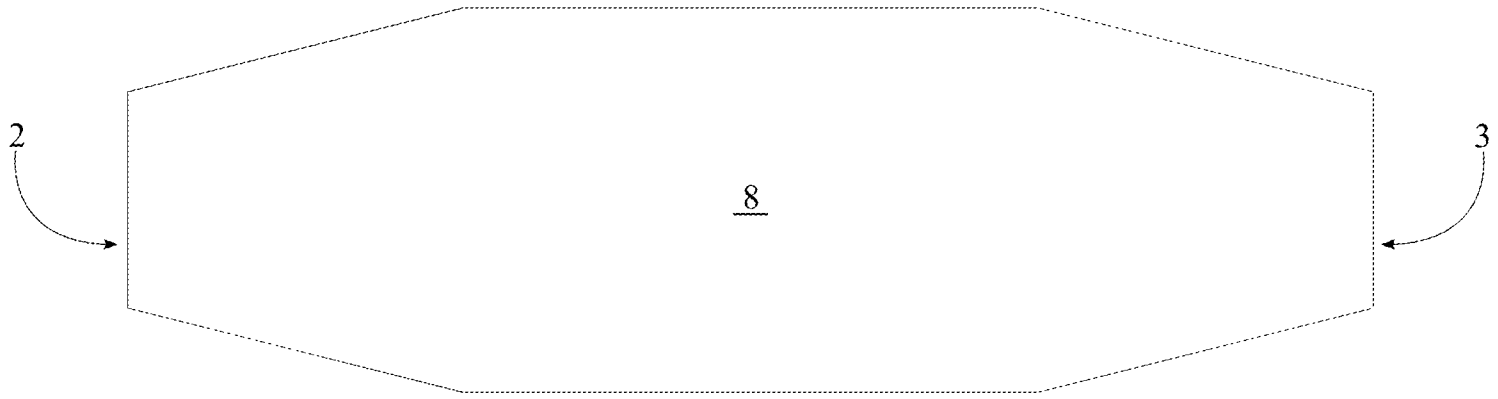
FIG. 3 is a front side view of the present invention in a flat configuration.
Figure 4:
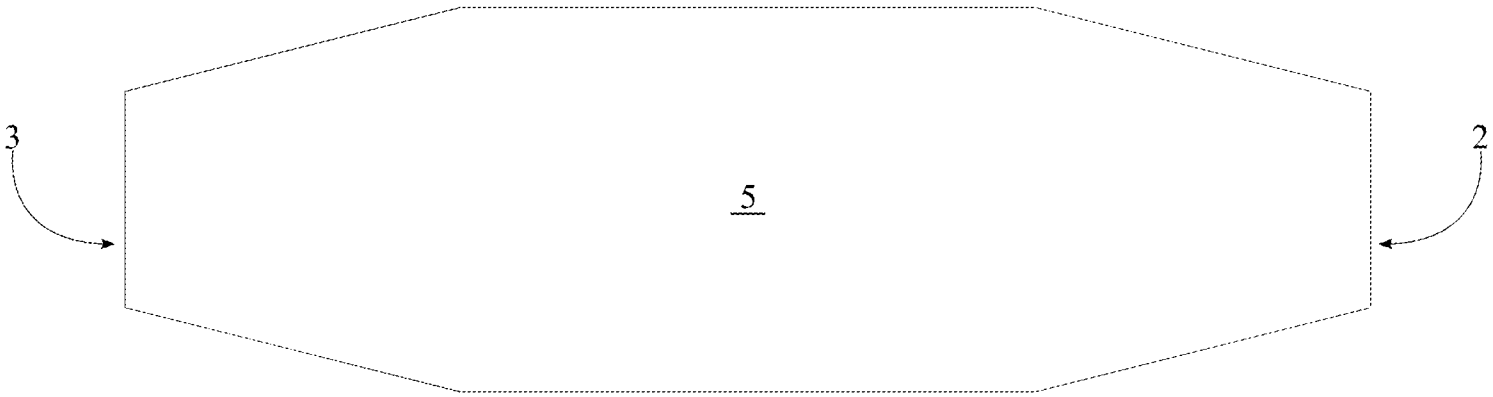
FIG. 4 is a back side view of the present invention in a flat configuration.
Figure 5:
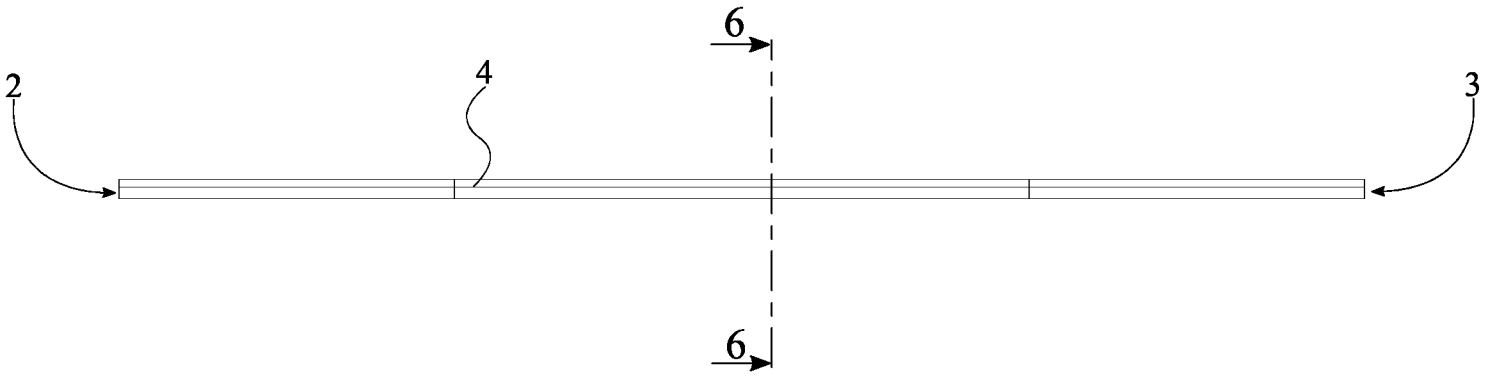
FIG. 5 is a top side view of the present invention in a flat configuration.
Figure 6:
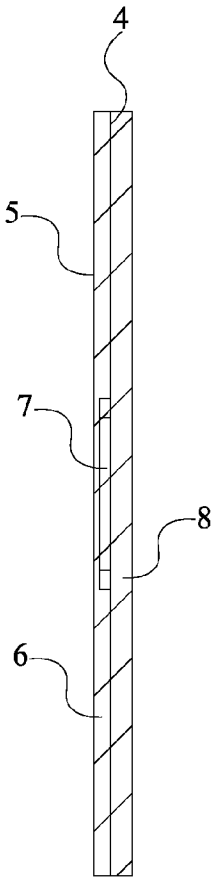
FIG. 6 is a cross-sectional view of the present invention in a flat configuration.

In reference to the preferred embodiment of the present invention, the coiled cuff body 1 and the insulating layer 8 are fixed to on another. The preferred embodiment of the present invention comprises an adhesive that fastens the coiled cuff body 1 and the insulating layer 8 to each other. More specifically, the coiled cuff body 1 comprises a first tapered end 2, a second tapered end 3, a convex surface 4, and a concave surface 5. Both the first tapered end 2 and the second tapered end 3 allows the coiled cuff body 1 to completely wrap around beverage containers of varying shapes while the top edge of the first tapered end 2 and the top edge of the second tapered end 3 remain adjacent each other. The convex surface 4 and the concave surface 5 are positioned opposite to one another, where the insulating layer 8 is superimposed across and coextensive with the convex surface 4. This arrangement is illustrated in the front side and back side view of FIG. 3 and FIG. 4 respectively. The concave surface 5 is the exterior surface of the present invention. The user's hand or any other retaining apparatus comes into direct contact with the concave surface 5 of the coiled cuff body 1. Both the convex surface 4 and the concave surface 5 traverse from the first tapered end 2 to the second tapered end 3. The first tapered end 2 and the second tapered end 3 are positioned opposite of each other along the coiled cuff body 1, as shown in the top view of FIG. 5. Both the first tapered end 2 and the second tapered end 3 secure the engaged beverage container within the coiled cuff body 1. The first tapered end 2 and the second tapered end 3 are aligned with one another so that the coiled cuff body 1 and the insulating layer 8 are able to grip around the engaged beverage container.

The general configuration of the aforementioned components allows the present invention to effectively surround any beverage container. In order to effectively surround a variety of beverage containers, the preferred embodiment of the coiled cuff body 1 comprises a bendable cuff-shaped shell 6 and a torsion spring 7. The bendable cuff-shaped shell 6 houses the torsion spring 7. More specifically, the torsion spring 7 is mounted within and along the bendable cuff-shaped shell 6, as shown in the cross-sectional view of FIG.

6. The preferred embodiment of the general configuration of the aforementioned components comprises a torsion spring 7 that is concealed from the outer surfaces of the present invention. However, it should be understood that the torsion spring 7 may be visible in varying embodiments. The torsion spring 7 defines the coiled structure of the coiled cuff body 1. The torsion spring 7 applies pressure to the beverage container so that the coiled cuff body 1 can be secured around the engaged beverage container.

Figure 7:
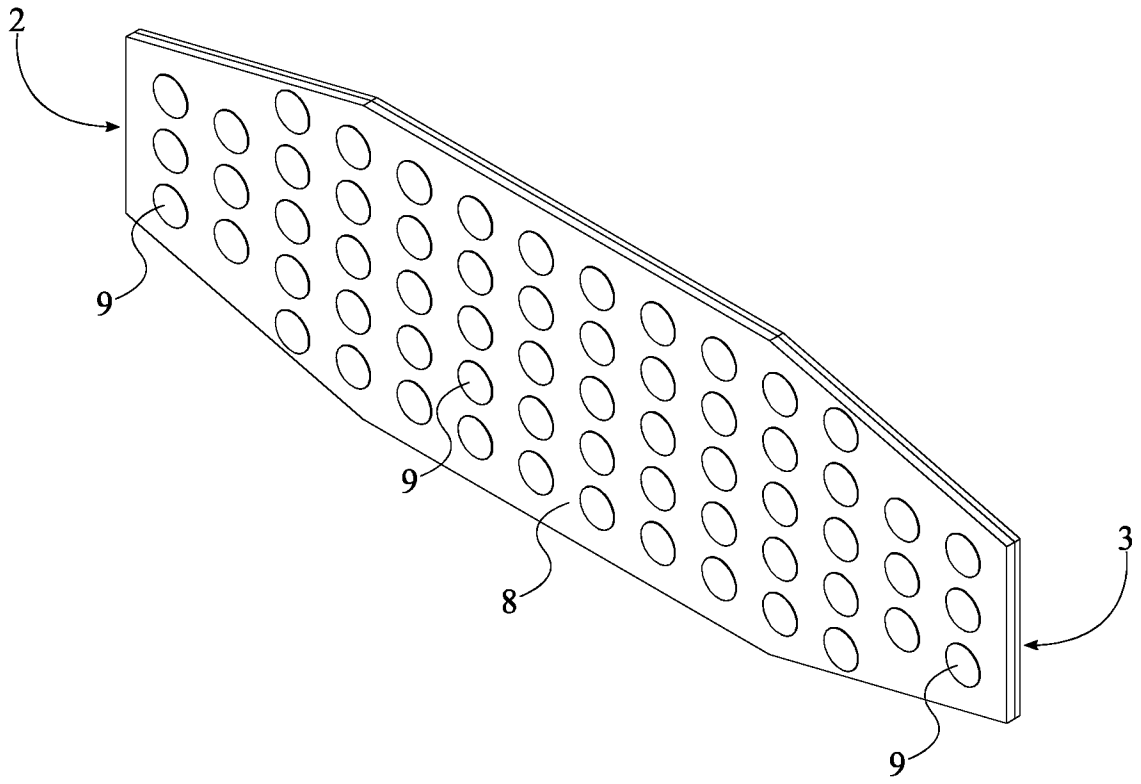
FIG. 7 is a front perspective view of the present invention with a plurality of non-slip members in a flat configuration.

An alternate embodiment of the present invention may comprise a coiled cuff body 1 that is a torsion spring 7. The coiled cuff body 1 as the torsion spring 7 comprises a first tapered end 2, a second tapered end 3, convex surface 4 and a concave surface 5. The coiled cuff body 1 as the torsion spring 7 itself is fixed to the insulating layer 8 in the same manner and arrangement as that of the coiled cuff body 1 of the preferred embodiment. More specifically, the insulating layer 8 is superimposed and coextensive with the coiled cuff body 1 as the torsion spring 7 as shown in FIG. 7.

In order to more effectively secure a beverage container within the grasp of the coiled cuff body 1 and the insulating layer 8, the present invention may further comprise a plurality of non-slip members 9. Each of the plurality of non-slip members 9 increases the friction between the insulating layer 8 and the engaged beverage container. The plurality of non-slip members 9 includes but are not limited to rubber tabs, rubber grooves, and suction cups. The plurality of non-slip members 9 is integrated across the insulating layer 8 and oriented towards the engaged beverage container, as illustrated in FIG. 7. As a result, the plurality of non-slip members 9 slidably engages with the beverage container preventing any unwanted slipping of the beverage container.

In a flat configuration, the present invention is disengaged from a beverage container. More specifically, the coiled cuff body 1 and the insulating layer 8 are positioned parallel to one another while in the flat configuration. In a flat configuration, a force is applied to distance the first tapered end 2 and the second tapered end 3. In a rolled configuration, the present invention grasps onto and wraps around a beverage container. More specifically, the first tapered end 2 overlaps the second tapered end 3 while in the coiled configuration, as shown in FIG. 1. Alternatively, the second tapered end 3 may overlap the first tapered end 2 in the coiled configuration. The user may slip a beverage container into either opening defined by the rolled configuration of the coiled cuff body 1 and the insulating layer 8. The first tapered end 2 and the second tapered end 3 of both the coiled cuff body 1 and the insulating layer 8 push apart depending on the width of the beverage container. The user may force the present invention in the flat configuration and wrap the present invention around a beverage container.

Although the invention has been explained in relation to its preferred embodiment, it is to be understood that many other possible modifications and variations can be made without departing from the spirit and scope of the invention as hereinafter claimed.

What is claimed is:

1. A universal insulating beverage container comprising:
- a coiled cuff body;
- an insulating layer;
- a plurality of non-slip members;
- an adhesive;
- the coiled cuff body comprising a first tapered end, a second tapered end, a convex surface and a concave surface;
- the insulating layer being superimposed across the convex surface;
- the insulating layer being coextensive with the convex surface;
- the first tapered end and the second tapered end being positioned opposite to each other along the coiled cuff body;
- the coiled cuff body being selectively in a rolled configuration;
- the first tapered end and the second tapered end contacting against and overlapping each other in response to the coiled cuff body being in the rolled configuration;
- the first tapered end and the second tapered end being movable with respect to each other along the coiled cuff body in response to the first tapered end and the second tapered end contacting against and overlapping each other;
- the coiled cuff body comprising a torsion spring for applying pressure to the insulating layer;
- the coiled cuff body comprising a bendable cuff-shaped shell;
- the torsion spring being mounted within and along the bendable cuff-shaped shell;
- the plurality of non-slip members being integrated across the insulating layer;
- the adhesive being disposed in between the coiled cuff body and the insulating layer for fastening the coiled cuff body and the insulating layer with each other; and
- each of the plurality of non-slip members being a suction cup.

2. The universal insulating beverage container as claimed in claim 1 comprising:
- the coiled cuff body being selectively in a flat configuration; and
- the coiled cuff body and the insulating layer being positioned parallel to each other when the coiled cuff body is in the flat configuration.

3. The universal insulating beverage container as claimed in claim 1 comprising:
- the first tapered end overlapping the second tapered end when the coiled cuff body is in the rolled configuration.

4. The universal insulating beverage container as claimed in claim 1 comprising:
- the second tapered end overlapping the first tapered end when the coiled cuff body is in the rolled configuration.

5. The universal insulating beverage container as claimed in claim 1 comprising:
- the coiled cuff body being made of plastic materials or metal materials; and
- the insulating layer being made of neoprene materials or foam materials.

6. The universal insulating beverage container as claimed in claim 1 comprising:
- each of the plurality of non-slip members being made of rubber materials.

* * * * *